US007883758B2

(12) United States Patent
Engelke

(10) Patent No.: US 7,883,758 B2
(45) Date of Patent: Feb. 8, 2011

(54) PROMOTIONAL SCARF

(76) Inventor: Erik C. Engelke, 944 Yachtsman Way, Annapolis, MD (US) 21403

( * ) Notice: Subject to any disclaimer, the term of this patent is extended or adjusted under 35 U.S.C. 154(b) by 325 days.

(21) Appl. No.: 12/053,423

(22) Filed: Mar. 21, 2008

(65) Prior Publication Data

US 2008/0241463 A1 Oct. 2, 2008

Related U.S. Application Data

(60) Provisional application No. 60/907,414, filed on Apr. 2, 2007.

(51) Int. Cl.
*B32B 7/08* (2006.01)
*A41D 23/00* (2006.01)

(52) U.S. Cl. ..... 428/102; 428/4; 446/27

(58) Field of Classification Search ..... 428/102, 428/4, 7, 101; 2/207; 28/147; 446/27
See application file for complete search history.

(56) References Cited

U.S. PATENT DOCUMENTS 1,750,844 A * 3/1930 Jopson ..... 428/115
2005/0125878 A1* 6/2005 Bjelland ..... 2/207
2009/0113599 A1 5/2009 Lovett

* cited by examiner

*Primary Examiner*—Alexander Thomas
(74) *Attorney, Agent, or Firm*—Morrison & Foerster LLP

(57) ABSTRACT

A fabric article made of at least four layers of fabric-such as fleece-with each of the fabric layers being a solid color selected from a combination of more than one color. The length portion of each fabric layer being greater than the width portion, e.g., five times longer than wide, and each fabric layer having fringes cut from a width portion into a center portion of the fabric layer. All of the layers of fabric being attached together along center portions of the layers of fabric with the length portions of the layers of fabric being parallel to each other.

18 Claims, 1 Drawing Sheet

PROMOTIONAL SCARF

CROSS-REFERENCE TO RELATED APPLICATION

This application claims priority to U.S. Provisional Application Ser. No. 60/907,414, filed Apr. 2, 2007.

BACKGROUND OF THE INVENTION

The present invention relates to an article made of fabric that can be used to demonstrate support for a sports team or other organization, by displaying team colors or organization colors, and also can be used as a garment that may be worn, for example, about the neck, over the shoulder or about the waist.

Different types of garments have been made, sold and worn by supporters of sports teams and other organizations. These garments include hats, scarves, sweaters, sweatshirts, jackets, etc. A typical and predominant characteristic that distinguishes these garments as being associated with showing support for a sport team or other organization is that the fabrics used to make the garments are dyed or woven to show colors associated with the team or organization. Such color patterns typically are a pair of colors For example, a scarf so made can have alternating colored bands. Alternatively, there could be three or more colors for an organization such as flag colors for a nation.

A variation for such a scarf used to show support for a sports team is use of three layers of solid colored fabric sown together to make a scarf. Each of the three fabrics is a solid color. A scarf or any other article made of three layers of fabric intended to display a pair of colors however will fail to equally present both colors because two layers will be one color and only one layer will be the other color. Further, the loft—total thickness resulting from the stitched three layers—that provides thermal insulation to keep a person warm who wears the scarf is limited to that provided by the three layers of fabric. These and other limitations are overcome by the scarf of the present invention.

BRIEF SUMMARY OF THE INVENTION

It is an object of the present invention to provide a fabric article that may be both used to effectively demonstrate support for a sports team or other organization by demonstrably displaying team colors and also be worn about the body to provide effective protection from cold temperatures.

The present fabric article for one embodiment has a configuration including at least four layers of fabric that can be layers of fleece fabric. Two of the fabric layers are one color and the other two fabric layers are the other color for a sports team. Each of these fabric layers can be rectangular in shape with a length that is at least five (5) times greater than a width portion of the fabric layer. For a preferred embodiment, the lengths of the four fabric layers are sixty-six (66) inches and the widths are seven (7) inches. Further, each fabric layer has fringes cut into both width portions toward the center portion. These fringes can be rectangular or of other appropriate shape with lengths being about two and half (2.5) inches and widths of about up to three quarter (0.75) inches. Alternatively the length of the layers may be 57 inches with a width of eight (8) inches. To make the fabric article all of the layers of fabric are attached together by stitching along center portions of fabric with the length portions of the layers of fabric being parallel to each other. The attached fabric layers are arranged to have fabric layer colors alternate so that fabric layers of the same color are not in contact with each other. At one or both ends of the scarf one or more layers may have an area with no fringes. The area may be 5 inches or other suitable length. One purpose of the area may be to carry a logo or other decoration.

Thus, the fabric article can be held in the hand and waved about to essentially equally show the pair of a sports teams' colors. This arrangement facilitates being able to both enthusiastically and effectively demonstrate support for a sports team. Prior arrangements included only three fabric layers for an assembled scarf. Therefore, the scarf in having an odd number of fabric layers results in only one layer being one color and two layers being the other color. This unequal color distribution results in an unbalanced and muted display of team colors, whereas the present fabric article provides for equal display of team colors with its even number of fabric layers.

Further, the combination of four or more even numbered layers of fabric, especially fleece, provides and increased loft over prior garments, which when worn about a person keeps that person warmer.

More than four fabric layers can be used in the instance of organizations having more than a pair of colors. For example, a national flag can have three colors. In this instance six or so layers of fabric can be used to assemble the fabric article.

These and other embodiments of the present invention will become apparent to those or ordinary skill in view of disclosures herein.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE PREFERRED EMBODIMENT

Embodiments of the present invention are described herein in the context of a four layer fabric article. Those of ordinary skill in the art will realize that the following detailed description of the present invention is illustrative only and is not intended to be in any way limiting. Other embodiments of the present invention will readily suggest themselves to such skilled persons having the benefit of this disclosure. For example, making the fabric article from more than four layers of fabric. Reference will now be made in detail to implementations of the present invention as illustrated in the accompanying drawings. The same reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specification decisions must be made in order to achieve the developer's specific goals, such as compliance with application—and business-related constraints, and that these specific goals will vary from one implementation to another and from one developer to another. Moreover, it will be appreciated that such a development effort might be complex and time-consuming, but would nevertheless be a routine undertaking of engineering for those or ordinary skill in the art having the benefit of this disclosure.

Figure 2:
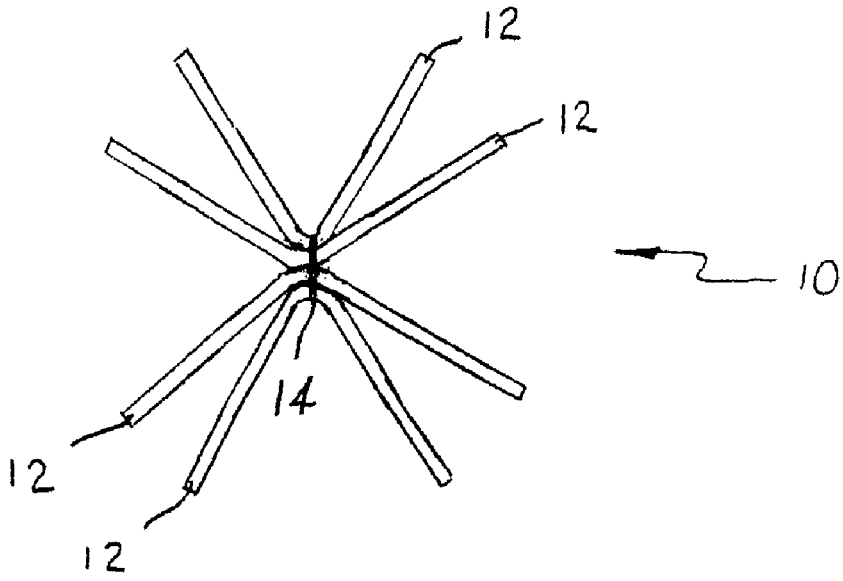
FIG. 2 is an end view of an assembled embodiment for the present fabric article.

The present fabric article, designated with the general numeral 10 (see FIG. 2), consists of four layers of fabric 12 that are stitched 14 together. Alternatively, the fabric article 10 can be assembled by using more than four layers of fabric 12. However, the number of layers of fabric 12 preferably should be an even number when the layers of fabric 12 are made in pairs of solid colors. One layer of fabric 12 in fabric article 10 is one solid color and the adjoining layer of fabric 12 is the other color of the pair of colors. By having an even number of layers of fabric 12, the pair of colors are equally represented with the same number of layers of fabric 12 being one color and also the same number of layers of fabric 12 being the other color. When there is an odd number of colors, the number of fabric layers also can be odd as long as there are four or more fabric layers.

Figure 1:
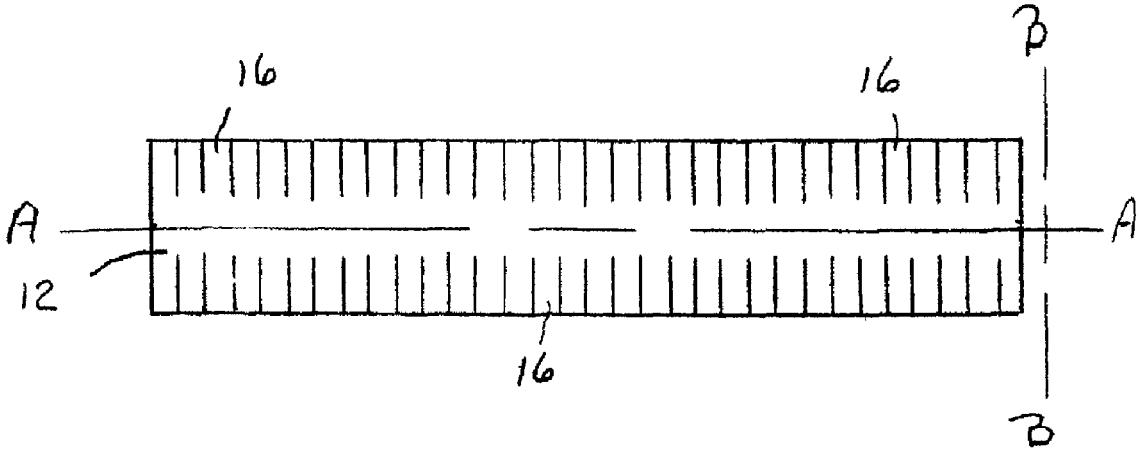
FIG. 1 is a top view of a fabric layer for the present fabric article.

An example of a layer of fabric 12 is shown in FIG. 1. The layer of fabric 12 is rectangular in shape having a lengthwise longitudinal axis A-A, and a width axis B-B that is perpendicular to the longitudinal axis A-A.

Cut into the layer of fabric 12 are fringes 16. These fringes 16 can be rectangular, triangular or other shapes The fringes 16 can have straight end edges, curved edges or other shaped edges. As an example the fringes 16 can be 2.5 inches long and 0.75 inches wide. Other dimensions can also be used. A purpose for such fringes 16 is to increase the apparent visible surface area displaying colors and to also show a pulsing effect as the fabric article 10 is waved thereby drawing visual attention to the pair of colors being displayed. When four or more layers of fabric 12 are assembled for attachment as fabric article 10, fringes 16 can be aligned to overlay each other or they can be arranged so as not be aligned. Further, fringes 16 of different shapes can be cut in alternate layers of fabric 12 or fringes 16 of different shapes can be cut in the same layer of fabric 12.

Assembled fabric article 10 can have a longitudinal length that is 66 inches long and 7 inches wide. The intent is that the shape be rectangular. Therefore, the length portion can be at least five times longer than a width portion.

While embodiments and applications of this invention have been shown and described, it would be apparent to those skilled in the art of having the benefit of this disclosure that many more modifications than mentioned above are possible without departing from the invention concepts herein. The invention, therefore, is not to be restricted except in the spirit of the appended claims.

What is claimed is:

1. A fabric article made of multiple layers of fabric, said fabric article comprising:

at least four layers of fabric, each of said layers of fabric being a solid color selected from a combination of more than one color, each of said layers of fabric having a length portion that is at least five times greater than a width portion of said layer, and each of said layers of fabric having fringes cut from a width portion into a center portion of said layers of fabric; and all of said layers of fabric are attached together along longitudinal center portions of said layers of fabric with the length portions of said layers of fabric being parallel to each other, wherein at least one of said layers has an end portion with an area without fringes and bearing a decorative image.

2. The fabric article of claim 1 wherein said layers of fabric are made of fleece.

3. The fabric article of claim 1 wherein said layers of fabric are an even number greater than four.

4. The fabric article of claim 1 wherein the attached layers of fabric are arranged so as to have each adjoining layer of fabric be a different color.

5. The fabric article of claim 1 wherein each layer of fabric is 66 inches long and 7 inches wide.

6. The fabric article of claim 1 wherein the fringes cut into each layer of fabric is rectangular in shape.

7. The fabric article of claim 1 wherein the fringes cut into each layer of fabric is about 2.5 inches long and about 0.75 inches wide.

8. The fabric article of claim 1 wherein said layers of fabric are aligned prior to attachment to have fringes from adjoining layers aligned to overlay each other.

9. The fabric article of claim 1 wherein said layers of fabric are aligned prior to attachment to not have fringes from adjoining layers aligned to overlay each other.

10. The fabric article of claim 1 wherein attachment of said layers of fabric is made by a line of stitching.

11. The fabric article of claim 1 wherein each layer of fabric is 57 inches long and 8 inches wide.

12. The fabric article of claim 1 wherein the area without fringes is 5 inches long.

13. A method of making a fabric article comprising:

providing at least four layers of fabric, each of said layers of fabric being a solid color selected from a combination of more than one color, and each of said layers of fabric having a length portion that is at least five times greater than a width portion of said layer;

cutting fringes from a width portion into a center portion of each of said layers of fabric;

attaching all of said layers of fabric together along longitudinal center portions of said layers of fabric with the length portions of said layers of fabric being parallel to each other; and providing at least one of said layers with an end portion comprising an area without fringes and bearing a decorative image.

14. The method of claim 13 further comprising:

arranging said layers of fabric prior to attachment so as to have each adjoining layer of fabric be a different color.

15. The method of claim 13 wherein the fringes cut into said layers of fabric are rectangular in shape.

16. The method of claim 13 further comprising aligning said layers of fabric prior to attachment to have fringes from adjoining layers aligned to overlay each other.

17. The method of claim 13 further comprising aligning said layers of fabric prior to attachment to have fringes from adjoining layers not aligned to overlay each other.

18. The method of claim 13 wherein the area without fringes is 5 inches long.

* * * * *